United States Patent [19]

Ronchi

[11] Patent Number: 4,854,059

[45] Date of Patent: Aug. 8, 1989

[54] STEAM IRON SOLE PLATE WITH PLUG INSERT

[76] Inventor: Costantino Ronchi, Via Giordano 5, 20090 Trezzano Sul Naviglio, Milan, Italy

[21] Appl. No.: 165,051

[22] Filed: Mar. 7, 1988

[30] Foreign Application Priority Data

Mar. 9, 1987 [IT] Italy ..... 21064/87[U]

[51] Int. Cl.[4] ..... D06F 75/10

[52] U.S. Cl. ..... 38/93; 38/77.8; 38/77.82

[58] Field of Search ..... 38/77.3, 77.83, 85, 38/88, 93, 77.8, 77.9, 77.7, 77.82, 77.6, 81; 219/245

[56] References Cited

U.S. PATENT DOCUMENTS

| | | | |
|---|---|---|---|
| 1,649,506 | 11/1927 | Brewer | 38/77.6 |
| 2,137,387 | 11/1938 | Chapin | 38/77.82 X |
| 2,160,421 | 5/1939 | Sebo | 38/77.6 X |
| 2,279,179 | 4/1942 | Schreyer | 38/77.82 |
| 2,495,397 | 1/1950 | Weber | 38/77.6 |
| 2,768,455 | 10/1956 | Hoecker | 38/77.82 |
| 3,949,499 | 4/1976 | Schaeffer et al. | 38/77.3 |
| 4,057,918 | 11/1977 | Zeier | 38/77.3 |

FOREIGN PATENT DOCUMENTS

| | | | |
|---|---|---|---|
| 886542 | 1/1962 | United Kingdom | 38/77.83 |

*Primary Examiner*—Andrew M. Falik

*Attorney, Agent, or Firm*—Guido Modiano; Albert Josif

[57] ABSTRACT

A steam iron sole plate comprises a substantially flat body in which an electric resistor is incorporated. The body defines in its interior a cavity open towards the rear face of the body. An insert can be applied so as to close the cavity and defines an inlet for the introduction of water and/or steam into the cavity. A plurality of holes for the delivery of steam, communicating with the cavity, is provided on the lower ironing face of the body.

20 Claims, 2 Drawing Sheets

STEAM IRON SOLE PLATE WITH PLUG INSERT

BACKGROUND OF THE INVENTION

The present invention relates to an a steam iron sole plate particularly for steam irons.

As is known, various types of plates for steam irons are available on the market which, generally, have a vaporization chamber constituted by a tortuous path capable of favoring the complete vaporization of water and any condensation of steam.

In the production of such types of sole plates, considerable constructive difficulties are encountered and furthermore there is no possibility of diversifying the internal construction of the plate according to contingent requirements unless a completely different plate is produced.

A severe problem encountered in the manufacture of sole plates for steam irons, resides in the fact that different types of sole plates must be manufactured with different highly specialized configurations in accordance with each particular type of iron into which they are eventually installed, and can neither be modified by a manufacturer according to the different types of irons produced, nor by a user according to different types of ironing to be performed.

Furthermore, another severe problem encountered in known types of sole plates and the vaporization chambers defined therein, relates to the possibility of removal of the calcareous deposits which generally impose limitations on the functional characteristics of said plate so as to allow its accessibility for cleaning.

In fact the criteria for the choice of location of the steam delivery zones are linked to the possibility of access to the vaporization chamber, thereby sacrificing the possibility of adopting different solutions.

Professional-type sole plates are furthermore known which are manufactured in an extremely complicated manner, which are generally very functional but which, since they do not have the possibility of access for the removal of any calcareous deposits, are limited in use to being steam-fed only.

SUMMARY OF THE INVENTION

The aim proposed by the invention is to solve the above described problems by providing a steam iron sole plate with plug insert or the like which, according to the contingent requirements of the user, can be water fed with vaporization of the water occurring directly in the plate, or steam fed, said steam possibly being superheated in the plate.

Within the above described aim, a particular object of the invention is to provide steam iron sole plate with plug insert or the like which allows substitution of a part thereof which is removably and rapidly connectable, to vary as desired the functionality of said plate, according to the contingent requirements of the users.

Still another object of the present invention is to provide steam iron sole plate with plug insert or the like which is easy to inspect, thus allowing easy and rapid removal of any calcareous deposits.

A further object of the present invention is to provide a steam iron sole plate with plug insert or the like which can be easily manufactured from elements and materials which are commonly commercially available, and which, furthermore, is competitive from a purely economical point of view.

The above described aim and objects, and others which will become apparent hereinafter, are achieved by a steam iron sole plate with plug insert or the like, according to the invention, comprising a substantially flat body incorporating an electric resistor, characterized in that said body internally defines a cavity open towards the rear face of said body, and in that it comprises at least one insert, adapted for closing said cavity and defining an inlet for permitting introduced water and/or steam into said cavity, said body defining a lower ironing face, having formed therin a plurality of steam delivery holes, communicating with said cavity.

BRIEF DESCRIPTION OF THE DRAWINGS

Further characteristics and advantages will become apparent from the description of a preferred but not exclusive embodiment of steam iron sole plate with plug insert or the like, shown in the accompanying illustrative, non-limitative drawings, wherein.

DESCRIPTION OF THE PREFERRED EMBODIMENTS

Figure 1:
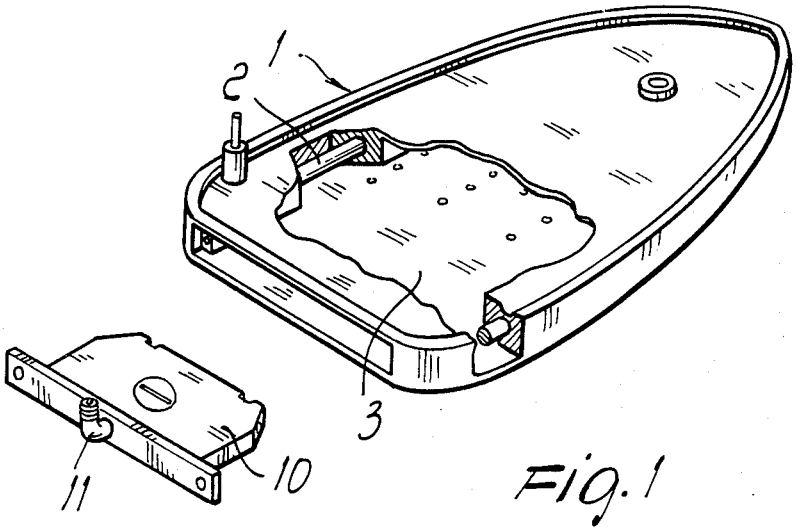
FIG. 1 is a schematic exploded perspective view of one embodiment of the sole plate.
Figure 2:
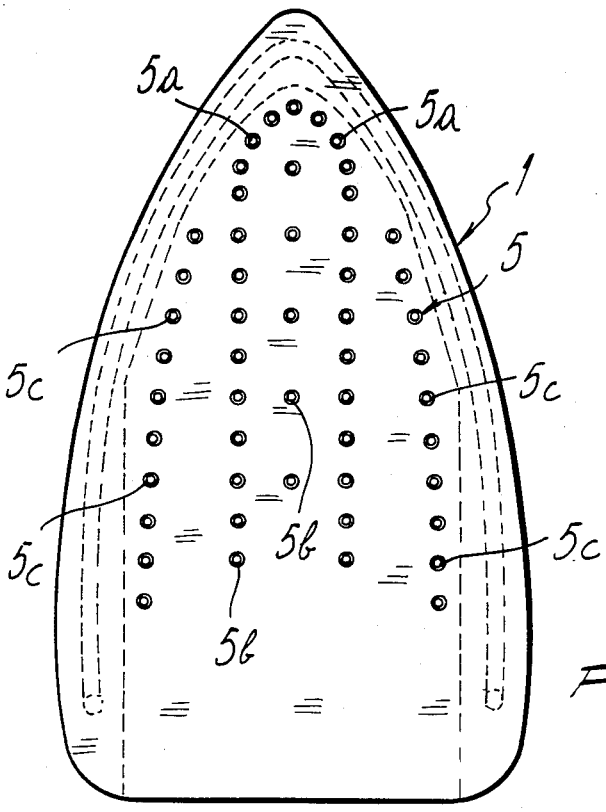
FIG. 2 is a schematic plan view of the body defining the cavity at its interior.

With reference to the above described figures, the steam iron plate with plug insert or the like, according to the invention, comprises a body, generally indicated by the reference numeral 1, which is preferably but not necessarily die-cast, and has a substantially flat lanceolate configuration, as is typical of sole plates for steam irons.

An electric resistor 2 is incorporated inside the body 1 and extends substantially at the perimetral zones, with the exception of the rear zone.

An important peculiarity of the invention resides in the fact that said body 1 defines at its interior a rearwardly open cavity 3.

The cavity 3 has, in transverse cross section, a substantially rectangular configuration, so as to simplify manufacture.

The peculiarity of the invention resides in the fact that said cavity may be closed by inserts sealingly applicable at the rear face, which may be variously shaped according to requirements of use, so as to modify the characteristics and the functionality of said plate according to the user's requirements, without thereby having to modify the configuration of the body.

The insert which is applied is structured so as to define the inlet for the introduction of water or steam inside the cavity.

As schematically indicated in FIG. 1, a plug insert 10 is provided which has defined therein an inlet 11 for the introduction of water or steam; in this solution the entire cavity is used without modifications which may vary its functionality.

Possibly one may introduce into the cavity metal wool 200 which has the function of retaining any water droplets, favoring a more rapid vaporization thereof also due to the fact that the surface area of contact between water and/or steam and the heated parts of the plate is increased.

The body 1 defines on its lower ironing face a plurality of through holes, generally indicated by the reference numeral 5, which connect the cavity 3 with the exterior to allow the outward delivery of steam.

Said holes may be variously positioned on the plate in such a manner as to create different delivery zones.

Merely by way of example, it is noted that in a preferred embodiment it is possible to provide holes, indicated at 5*a*, which affect the tip zone, holes indicated at 5*b* which affect the central zone and holes indicated at 5*c* which affect the lateral zones.

The holes 5*a*, 5*b* and 5*c* are variously usable, as a function of the type of insert which is inserted.

Figure 3:
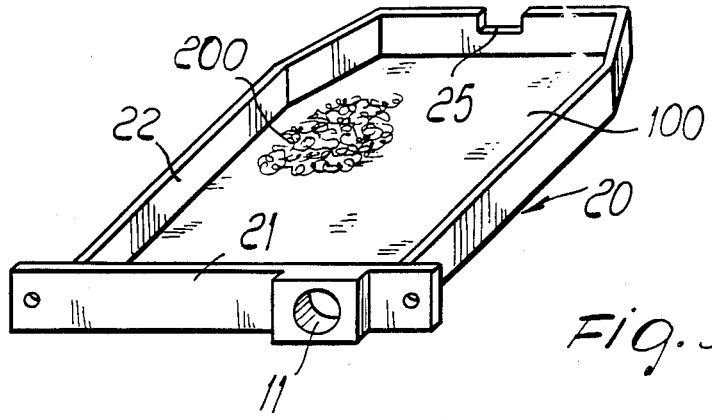
FIG. 3 is a schematic perspective view of an embodiment of an insert defining, inside the cavity, two mutually communicating separate chambers.

Thus, for example, as illustrated in FIG. 3, an insert, generally indicated by the reference numeral 20, has an end crosspiece 21 defining the water and/or steam inlet, indicated by the reference numeral 11, having a perimetral border 22, which separates the zone affected by the holes 5*a* from the zone affected by the holes 5*b* and 5*c*. A depression or recess 25 is provided on the perimetral border 22 so as to allow the passage of the steam from the chamber where the holes 5*b* and 5*c* are provided to the chamber where the holes 5*a* are provided.

In this embodiment it is possible to provide a sole member 100 which is rigidly associated with the perimetral border 22, and which may be configured as desired to obstruct all, or at least some of the through holes affected by the insert 20 (see FIG. 3).

Figure 4:
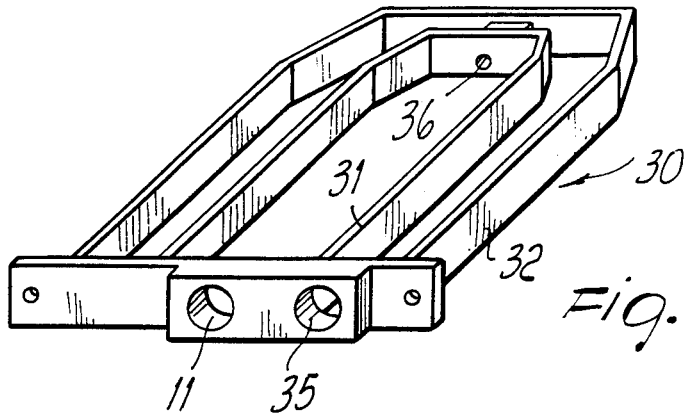
FIG. 4 is a view of a different insert providing, besides the vaporization chambers, an aspiration chamber.

In the embodiment illustrated in FIG. 4, the insert, indicated at 30, has besides the end crosspiece an inner border 31 and an outer border 32. The inner border delimits an inner chamber for the steam, while the inner border in cooperation with the outer border delimits an aspiration chamber. For this purpose an inlet 11 for the introduction of water and/or steam is connected to the inner chamber and an aspiration inlet, indicated at 35, is connected to the aspiration chamber arranged substantially at the holes 5*c*.

A through channel 36 is furthermore provided which connects the inner chamber, provided substantially in the zone affected by the holes 5*b*, to the tip zone affected by the holes 5*a*.

Also in this embodiment it is possible to provide in the inner chamber a sole member which closes the affected holes 5*b*.

Figure 5:
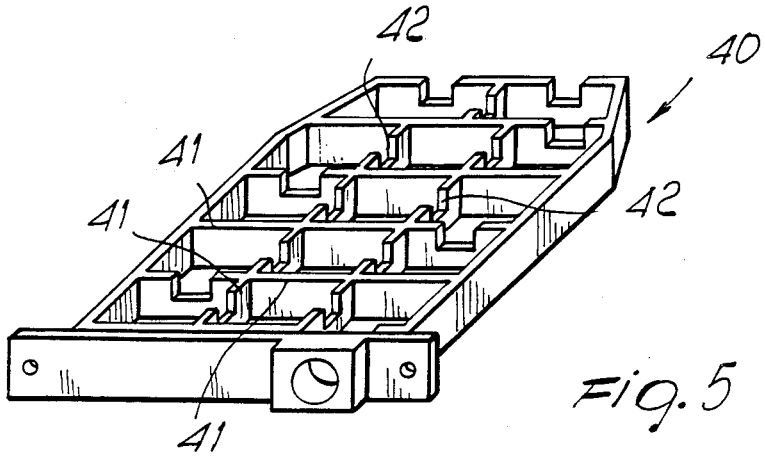
FIG. 5 is a view of an insert defining a tortuous path.

FIG. 5 illustrates an embodiment in which the insert 40 has a plurality of chambers defined by a plurality of transverse dividing walls 41 provided with upper recesses 42 which in practice provide a tortuous path through the chambers which facilitates vaporization, thus making this type of insert particularly suitable for feeding the electric plate with water rather than steam.

In this embodiment it is possible to provide a sole member for joining the dividing walls on the opposite side with respect to the recesses so as to create a succession of mutually intercommunicating cavities in which the water is gradually caused to vaporize, trapping the particles or water droplets which allow therefore a delivery of particularly dry steam in the tip region.

From what has been described above it can thus be seen that the invention achieves the proposed aims and in particular the fact is stressed that the provision of the plate with a rearwardly open inner cavity closed by inserts of various configurations allows the possibility of obtaining an improved functionality without modifying the configuration of the plate, but simply by modifying the type and the configuration of said insert, with the possibility therefore of variously employing the delivery holes which are distributed on the plate.

The invention thus conceived is susceptible to numerous modifications and variations, all of which are within the scope of the inventive concept.

Moreover all the details may be replaced with other technically equivalent elements.

In practice, any materials, contingent shapes, and dimensions, may be employed according to requirements.

I claim:

1. Steam iron sole plate with plug insert or the like comprising, at least one body, said body being substantially flat, at least one electric resistor incorporated in said body, a rear face defined by said body, at least one cavity defined in said body and being open at said rear face, at least one insert adapted for closing said cavity at said rear face of said body, a lower ironing face defined by said body, a plurality of holes formed in said lower ironing face of said body and communicating with said cavity, and, at least one inlet, said inlet being defined on said insert, communicating with said cavity, and being adapted for permitting introduction of at least one fluid selected from among water and steam into said cavity wherein said body defines at least one tip zone, at least one central zone, and a plurality of lateral zones, and wherein said plurality of holes are formed in said tip zone, in said central zone, and in said plurality of lateral zones.

2. Steam iron sole plate with plug insert or the like according to claim 1, wherein said insert comprises at least one end crosspiece and at least one perimetral border, said inlet being defined in said end crosspiece, said perimetral border extending from said end crosspiece and defining in said cavity at least one first chamber and at least one second chamber, said first chamber communicating with said holes formed in said central zone and said lateral zone of said body, said second chamber communicating with said holes formed at said tip zone of said body, said sole plate structure further comprising at least one recess, said recess being formed in said perimetral border, said first chamber communicating with said second chamber through said recess.

3. Steam iron sole plate with plug insert or the like according to claim 1, wherein said insert comprises;

at least one end crosspiece, at least one inner border extending from said end crosspiece, at least one outer border extending from said end crosspiece, at least one inner chamber delimited by said inner border, said inner chamber communicating with said holes formed in said central zone of said body, at least one aspiration chamber defined between said inner border and said outer border, said aspiration chamber communicating with said holes formed in said lateral zones of said body, and an aspiration inlet formed in said end crosspiece and communicating with said aspiration chamber, and wherein said inlet is formed in said end crosspiece and communicates with said inner chamber.

4. Steam iron sole plate with plug insert or the like according to claim 1, wherein said insert comprises;

at least one end crosspiece, a plurality of dividing walls, said dividing walls intersecting each other substantially perpendicularly and being interconnected to said end crosspiece, a plurality of chambers defined by said plurality of dividing walls, at least one edge defined by each dividing wall in said plurality of dividing walls, a plurality of recesses formed in said edge of each of said dividing walls and communicating with said plurality of chambers, wherein said plurality of recesses and said plurality of chambers define at least one tortuous path for steam.

5. Steam iron sole plate with plug insert or the like according to claim 1, further comprising at least one sole member, said sole member being rigidly associated with said insert and adapted for closing at least some of said plurality of holes formed in said lower ironing face of said body.

6. Steam iron sole plate with plug insert or the like comprising;

at least one body, said body being substantially flat, at least one electric resistor incorporated in said body, a rear face defined by said body, at least one cavity defined in said body and being open at said rear face, at least one insert adapted for closing said cavity at said rear face of said body, a lower ironing face defined by said body, a plurality of holes formed in said lower ironing face of said body and communicating with said cavity, and, at least one inlet, said inlet being defined on said insert, communicating with said cavity, and being adapted for permitting introduction of at least one fluid selected from among water and steam into said cavity, wherein said cavity defines a cavity bottom, and wherein said holes extend from said lower ironing face to said cavity bottom.

7. Steam iron sole plate with plug insert or the like according to claim 6, wherein said body defines at least one tip zone, at least one central zone, and a plurality of lateral zones, and wherein said plurality of holes extend from said lower ironing face to said cavity in said tip zone, in said central zone, and in said plurality of lateral zones.

8. Steam iron sole plate with plug insert or the like according to claim 6, wherein said at least one insert comprises a plug insert, said plug insert being adapted for closing said cavity.

9. Steam iron sole plate with plug insert or the like according to claim 6, further comprising metal wool, said body defining a heat exchange surface, said metal wool being accommodated within said cavity and adapted for trapping wate particles and increasing said heat exchange surface defined by said body.

10. Steam iron sole plate with plug insert or the like according to claim 7, wherein said insert comprises at least one end crosspiece and at least one perimetral border, said inlet being defined in said end crosspiece, said perimetral border extending from said end crosspiece and defining in said cavity at least one first chamber and at least one second chamber, said first chamber communicating with said holes formed in said central zone and said lateral zone of said body, said second chamber communicating with said holes formed at said tip zone of said body, said sole plate structure further comprising at least one recess, said recess being formed in said perimetral border, said first chamber communicating with said second chamber through said recess.

11. Steam iron sole plate with plug insert or the like according to claim 7, wherein said insert comprises;

at least one end crosspiece, at least one inner border extending from said end crosspiece, at least one outer border extending from said end crosspiece, at least one inner chamber delimited by said inner border, said inner chamber communicating with said holes formed in said central zone of said body, at least one aspiration chamber defined between said inner border and said outer border, said aspiration chamber communicating with said holes formed in said lateral zones of said body, and an aspiration inlet formed in said end crosspiece and communicating with said aspiration chamber, and wherein said inlet is formed in said end crosspiece and communicates with said inner chamber.

12. Steam iron sole plate with plug insert or the like according to claim 6, wherein said insert comprises;

at least one end crosspiece, a plurality of dividing walls, said dividing walls intersecting each other substantially perpendicularly and being interconnected to said end crosspiece, a plurality of chambers defined by said plurality of dividing walls, at least one edge defined by each dividing wall in said plurality of dividing walls, a plurality of recesses formed in said edge of each of said dividing walls and communicating with said plurality of chambers, wherein said plurality of recesses and said plurality of chambers define at least one tortuous path for steam.

13. Steam iron sole plate with plug insert or the like according to claim 6, further comprising at least one sole member, said sole member being rigidly associated with said insert and adapted for closing at least some of said plurality of holes formed in said lower ironing face of said body.

14. Steam iron sole plate with plug insert or the like comprising;

at least one body, said body being substantially flat, at least one electric resistor incorporated in said body, a rear face defined by said body, at least one cavity defined in said body and being open at said rear face, at least one insert adapted for closing said cavity at said rear face of said body, a lower ironing face defined by said body, a plurality of holes formed in said lower ironing face of said body and communicating with said cavity, and, at least one inlet, said inlet being defined on said insert, communicating with said cavity, and being adapted for permitting introduction of at least one fluid selected from among water and steam into said cavity, wherein said cavity defines a cavity bottom, and wherein said holes open into said cavity at said cavity botton.

15. Steam iron sole plate with plug insert or the like according to claim 14, wherein said body defines at least one tip zone, at least one central zone, and a plurality of lateral zones, and wherein said plurality of holes open into said cavity at said cavity bottom in said tip zone, in said central zone, and in said plurality of lateral zones.

16. Steam iron sole plate with plug insert or the like according to claim 14, further comprising metal wool, said body defining a heat exchange surface, said metal wool being accommodated within said cavity and adapted for trapping water particles and increasing said heat exchange surface defined by said body.

17. Steam iron sole plate with plug insert or the like according to claim 15, wherein said insert comprises at least one end crosspiece and at least one perimetral border, said inlet being defined in said end crosspiece, said perimetral border extending from said end crosspiece and defining in said cavity at least one first chamber and at least one second chamber, said first chamber communicating with said holes formed in said central zone and said lateral zone of said body, said second chamber communicating with said holes formed at said tip zone of said body, said sole plate structure further comprising at least one recess, said recess being formed in said perimetral border, said first chamber communicating with said second chamber through said recess.

18. Steam iron sole plate with plug insert or the like according to claim 15, wherein said insert comprises;

at least one end crosspiece, at least one inner border extending from said end crosspiece, at least one outer border extending from said end crosspiece, at least one inner chamber delimited by said inner border, said inner chamber communicating with said holes formed in said central zone of said body, at least one aspiration chamber defined between said inner border and said outer border, said aspiration chamber communicating with said holes formed in said lateral zones of said body, and an aspiration inlet formed in said end crosspiece and communicating with said aspiration chamber, and, wherein said inlet is formed in said end crosspiece and communicates with said inner chamber.

19. Steam iron sole plate with plug insert or the like according to claim 14, wherein said insert comprises;

at least one end crosspiece, a plurality of dividing walls, said dividing walls intersecting each other substantially perpendicularly and being interconnected to said end crosspiece, a plurality of chambers defined by said plurality of dividing walls, at least one edge defined by each dividing wall in said plurality of dividing walls, a plurality of recesses formed in said edge of each of said dividing walls and communicating with said plurality of chambers, wherein said plurality of recesses and said plurality of chambers define at least one tortuous path for steam.

20. Steam iron sole plate with plug insert or the like according to claim 14, further comprising at least one sole member, said sole member being rigidly associated with said insert and adapted for closing at least some of said plurality of holes formed in said lower ironing face of said body.

* * * * *